US006779202B1

(12) United States Patent
Alldredge

(10) Patent No.: US 6,779,202 B1
(45) Date of Patent: Aug. 24, 2004

(54) PLUNGER APPLIANCE FOR TOILETS

(76) Inventor: Andrew L. Alldredge, 1918 Sheridan Rd., Buffalo Grove, IL (US) 60089

( * ) Notice: Subject to any disclaimer, the term of this patent is extended or adjusted under 35 U.S.C. 154(b) by 0 days.

(21) Appl. No.: 10/370,368

(22) Filed: Feb. 20, 2003

(51) Int. Cl.[7] ..... E03D 9/00
(52) U.S. Cl. ..... 4/255.02
(58) Field of Search ..... 4/255.01–255.06, 4/255.08–255.12

(56) References Cited

U.S. PATENT DOCUMENTS 460,350 A * 9/1891 Cole ..... 15/104.31
1,644,436 A * 10/1927 Locke ..... 4/255.08
2,267,064 A * 12/1941 Wikelund ..... 4/255.03
3,391,026 A * 7/1968 Leiser ..... 134/24
3,480,021 A * 11/1969 Eward, Jr. ..... 134/24
4,358,861 A * 11/1982 Sard ..... 4/255.03
5,488,749 A * 2/1996 Pearce et al. ..... 15/105
6,067,668 A * 5/2000 Rudd ..... 4/255.11
6,216,283 B1 * 4/2001 Tash ..... 4/255.11

* cited by examiner

*Primary Examiner*—Gregory L. Huson
*Assistant Examiner*—Huyen Le
(74) *Attorney, Agent, or Firm*—Charles F. Lind

(57) ABSTRACT

The disclosed portable plunger has an elongated shaft with a hand gripping portion adjacent one end and a plunger head fixed to the shaft adjacent the opposite end. The plunger head has an impervious flexible material defining an exterior surface sized slightly larger than an outlet passage of a toilet bowl to be plunged. The head is also resilient and elastic to allow reduction of the exterior head surface to become smaller than the bowl passage to allow plunger head insertion into the passage, while then expanding and seating against the bowl passage walls in the mode of a piston positioned in the passage. Thus, axial shifting of the plunger head in the passage hydraulically creates water/waste pressure and/or flow surges in the passage, serving to break up downstream clogs therein.

5 Claims, 1 Drawing Sheet

44
26
34
30
14
30
40
42
16
32
12
22
10
24
18
20
46

46a
60
66
64
42
68
52
70
56
54
62

46b
96
94
92
95
93
91
90
42
74
76
88
72
80
86
84
82

PLUNGER APPLIANCE FOR TOILETS

BACKGROUND OF THE INVENTION

A typical toilet 10 is illustrated in FIG. 1, comprised of an upwardly open bowl 12 having an annular generally horizontal upper rim 14 and side walls 16 that converge downwardly from the underside thereof to a recessed bottom well 18. An outlet or trapway passage 20 from the bowl well 18 connects over an elevated weir dam 22 to an exit passage 24, for directing liquid/waste flow via an exterior drain line to a sewer, septic field or the like (none-being shown). A water storage tank 26 typically supported vertically above the bowl 12 provides flush water that can be discharged by gravity via appropriate internal routing passages (not shown) through outlet jets 28, 30 into the bowl 12. The jets 28 direct flush water through the bowl well 18 for priming flow of water/waste therein over the dam 22 and from the toilet via exit passage 24, and the jets 30 underlying the rim 14 direct flush water over the side walls 16 for rinsing them.

The dam 22 defines the maximum stable height (shown dotted along horizontal plane 32) that water can remain in the bowl before leaking over the dam and out the exit passage 24, which height might be 1–3 inches above the top opening of the well 18 and 4–8 inches below the bowl top 34. The trapway passage 20 extends somewhat as a cylindrical bore a short distance horizontally from the bowl well 18 before curving up and over the weir dam 22.

When the toilet is flushed, tank water flows into the bowl from both the jets 28 and 30, priming the water/waste in the well 18 to flow toward the weir dam 22 while the water level in the bowl 18 will rise above the weir dam 22, whereupon water/waste flow from the passage 24 will begin. This flow further can produce a siphoning action of the bowl well water/waste in flowing over the dam effective to substantially empty the bowl well 18 and the suction is broken. Continued flush water flow into the bowl from the jets 30 will rinse the bowl side walls 16 and refill the bowl 18 to the desired stable water level just below the weir plane 32.

The now demanded low consumption toilets can release less than 1.6 gallons of water per flush; whereby the passages 20, 24 have been made smaller in order to produce adequate velocities of discharging flow velocities. By way of example, some low consumption toilets have been sized for a 1 & ½ inch ball pass, meaning that the passages 20, 24 (approximately only ⅛ inch larger) might be only 1 & ⅝ inch diameters. This might be contrasted against the older water saving toilets having 2 & ½ inch ball pass passages.

A common drawback to these low consumption toilets, with the small water flushing head and volume, and the small and bending water/waste flow passages, is that the flow passages 20, 24 frequently become clogged by solid toilet waste/paper to preclude proper water/waste drainage from the toilet. With the toilet clogged, the flushed bowl water/waste levels can rise close to or even flow over the bowl top 34 and onto the surrounding floor.

Toilet plungers are commercially available suited for breaking up minor clogs, each typically having a long shaft with a bell-shaped head mounted at one end thereof. Specifically, the bell-shaped head-is made of a liquid-impervious deformable elastic material (rubber or synthetic polymer) and is sized to surround and cover the well top opening with its lower edge seated against the bowl side walls. The plunger head thus is significantly larger laterally than the well top opening, or possibly 4–6 inch diameter laterally and almost the same size axially of the shaft.

Moreover, the shaft typically is approximately 3 feet long, to be gripped and manipulated with sufficient leverage from vertically above the toilet bowl for deforming the plunger head and creating water pressure surges to act against the blocked water/waste in the passages. The plunger thus commonly is large, unattractive, and difficult to hide near the toilet where needed; so that frequently it is inconveniently stored away from the toilet.

SUMMARY OF THE INVENTION

A basic object of the invention is to provide a compact toilet plunger, having a shaft and head significantly smaller than conventional plungers, while yet effective when needed for clearing toilet clogs and for accommodating convenient and more attractive optional storage, such as in the bathroom, proximate its region of needed use.

A more detailed object of the invention is to provide a toilet plunger having a head sized to be fitted into the bowl well outlet or trapway passage, suited for establishing a sealed piston-like relationship therewith, whereby axial manipulation of the plunger head in bowl outlet trapway passage directly creates liquid surges and/or pressure variations within the passage suited to clear minor toilet clogs therein.

DESCRIPTION OF PREFERRED EMBODIMENTS OF THE INVENTION

Figure 1:
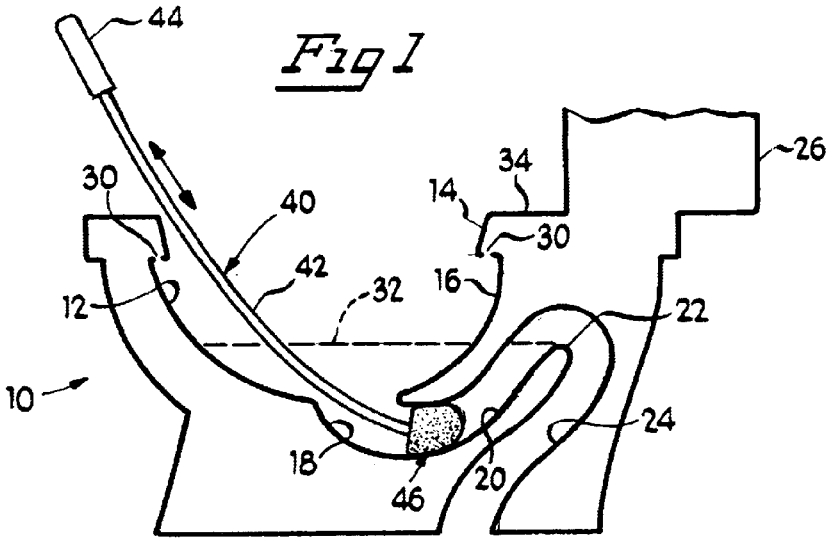
FIG. 1 is an elevational sectional view of a typical toilet, with only the relevant bowl passages illustrated for the sake of simplicity of the disclosure, where the subject toilet plunger is illustrated in a typical operative association therewith operable to clear clogs in the outlet passage.

An inventive toilet plunger 40 is illustrated in FIG. 1 in operative association with the typical toilet 10, the plunger being comprised of an elongated shaft 42 having a handle portion 44 adjacent one shaft end and a plunger head 46 fixed to the opposite shaft end. Major differences between the inventive plunger 40 and prior known plungers can be appreciated when comparing the sizes and shapes of the respective plungers, and the piston like mode of operation of the disclosed plunger head 40 within the toilet trapway passage 20.

Thus, the plunger head 46 is sized to fit as a piston in generally sealed cooperation within the outlet or trapway passage 20 immediately proximate and inwardly from the bowl well 18. The plunger shaft 42 is sized to locate its hand gripping handle portion 44 above the bowl top edge 34 across the bowl well 18 from the passage 20. This would allow a user to grip the head 46 above any toilet water/waste in the bowl and to position the head into and to axially and operatively manipulate it within the passage 20.

The shaft 42 can be bowed slightly, as illustrated in FIG. 1, or can be straight but preferably then can be somewhat flexible laterally to allow minor lateral bowing. However, the shaft should be non compressible axially, so that axial movement of the plunger handle will be transmitted directly to the head.

At least the outer exposed surfaces of the plunger head 46 is made of a non absorbent and impervious material resistant to toilet water/waste, such as of a rubber or polymer. Moreover, the material should be resilient, flexible and elastic so that the head can be laterally and/or radially deformed, if needed, to provide that at least a circumferential band of its periphery can substantially and sealingly engage the passage walls, as the head is fitted into the trapway passage 20 and/or should the head when fully inserted in the passage end up to be slightly canted from true coaxial and/or centered alignment therewith. With at least a periphery band substantially sealed relative to the bowl passage walls, and with its impervious body act as a barrier crossing the bowl passage, the inserted head serves as a piston in sealed association relative to the walls of the passage 20.

Any axial head movement, with the head acting as a piston within the passage, will hydraulically create water pressure variations or flow surges in the passage 20 beyond the head. Such water pressure variations and/or flow surges have been found highly effective in dislodging or breaking up waste clogs in the passage ahead of the plunger.

Figure 2:
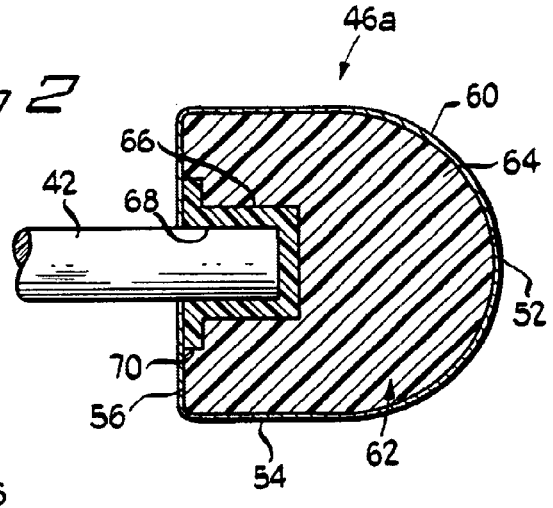
FIGS. 2 and 3 respectively illustrate enlarged sectional views of different heads usable on the toilet plunger.

FIG. 2 illustrates in greater detail a plunger head 46*a*, with an exposed surface of generally spherical front shape blending rearwardly from a central nose 52 to a substantially cylindrical side wall section 54, and with a rear wall 56 extended transverse to the shaft 42 and the bowl passage 20.

The expanding plunger walls rearwardly of the front nose section 52 effectively guides or otherwise provides for easy head entry of the side wall section 54 into the passage. The side wall section 54 is sized slightly larger than the bowl passage 20, so that when inserted into the passage, such will be compressed and will provide radially outward force pressuring the head against the passage walls. The combination of the axial extent of the annular head sealing region and/or the mechanical force of this sealing region against the bowl passage walls determines the effectiveness of the seal, which should be sufficient to minimize bowl water/waste leakage past the inserted plunger head.

Practically, the sealing area of the side wall section 54 should extend axially at least ¼ inch and possibly in excess of an inch or so operable to provide adequate annular sealing effective under most operating conditions of the plunger. When so designed, axial head manipulation within the passage 20 can directly create hydraulic pressure buildups and/or flow surges of water/waste in the passage needed for dislodging or breaking up waste clogs therein.

The head might be made up of a thin flexible impervious outer layer or cover 60 completely surrounding an interior fill 62 and sealing it from any bowl water or the like. The fill 62 would be made of a mass 64 of elastic or springy material sufficient to accommodate inward collapse upon entry of the head into the bowl passage and then provide an outward force to seat the cover against the bowl passage walls. Specifically, the cover 60 might be made of an impervious closed cell rubber or polymer material, while the fill mass 64 might be an open cell sponge of rubber or like resilient material. Alternatively, the fill mass might be made up from loosely entangled strands of a springy metallic or polymer material, or might even be made up of a sealed gas-filled balloon.

A hard body socket 66, such as of plastic, can be formed as part of the fill 62, with an opening 68 suited to receive and hold the end of the shaft 42. Means can be provided to hold the shaft and socket components together, such as permanently with an adhesive, separably with cooperating threads on each, or via snap action shoulders/tabs respectively formed on the components (neither latter alternative being shown). A radial socket wall 70 adjacent the rear head wall 56 and extending part way to the side wall section 54 can strengthen the head 46*a* against axial deformation without detracting from its radial collapsibility, and further can provide a radial surface that the cover 60 can be bonded or fused to make the head liquid-tight.

Figure 3:
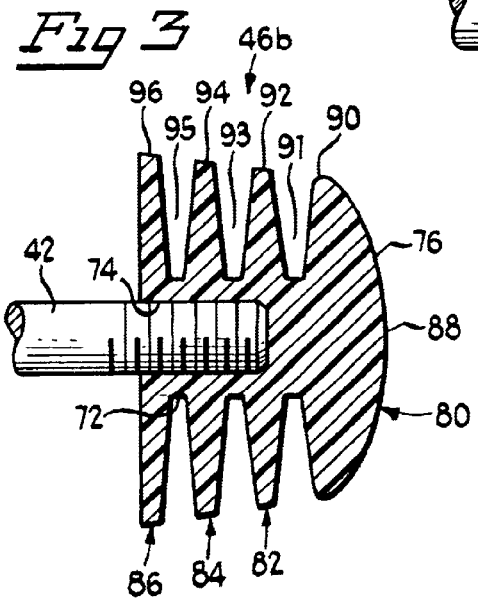

FIG. 3 illustrates another plunger head 46*b*, where the hub 72 having a rear opening 74 for connection to the shaft 42 and having a convex front surface 76 sized for easy insertion into the bowl passage. The head has annular lobes 80, 82, 84 and 86 radially formed off of the central hub 72, separated from one another across radial annular gaps 81, 82, 85. The front surface 76 on lobe 80 is convex rearwardly from a center point 88, and blends into an annular generally cylindrical perimeter surface 90. The other annular lobes 82, 84 and 86 respectively also have annular generally cylindrical exposed perimeter surface 92, 94 and 96.

Although exterior annular surfaces 76, 90, 92, 94 and 96 are not continuous, the overall shape of the head 46*b* might corresponds generally to the shape of the head 46*a*. At least the rear lobes 84 and 86 (and possibly even lobe 82) will be larger than the bowl passage, suited to require some flexure when such lobes are being inserted into the bowl passage.

The head 46*b* should be formed throughout of a liquid impervious material that is also flexible and resilient, such as a closed cell rubber, so that the exposed head surfaces will be impervious to the bowl water/waste. Further, the gaps between the lobes allow each lobe to be flexed in directions both axially and radially of the head, suited when fitted into the passage 20 to achieve a head sealing or piston fit within the bowl passage, even should the head be axially misaligned with the passage. The convex nose surface 76 provides for easy initial head entry into the bowl passage.

The axial separation of the lobes might be between ¼ and ½ inch, with each annular perimeter surface being between ⅛ and ½ inch axially, for establishing a preferred annular piston cooperation effective to block and close the passage.

As above noted and as illustrated in FIG. 1, the shaft 42 should be substantially nonextendable axially, and might also be of a length to position the hand gripping portion 44 above the top edge 34 of the toilet bowl 12 opposite the bowl passage 20 while the plunger head 46 is fitted in the passage. Further, the shaft should either be bowed permanently or be flexible to have its ends curve between approximately 25–40 degrees from a straight shaft. This will allow the head to be inserted into the bowl passage 20 and subsequently shifted axially within the passage, while minimizing head misalignment within the passage and thereby achieving and maintaining a piston like sealed association with the passage.

For use with a low consumption toilet where the passages 20, 24 might be only approximately 1 & ⅝ inch in internal diameter, the disclosed plunger heads might have an outer cross diameter between 2 and 3 inches. The head might have a generally similar axial length. The plunger shaft 42 might be between 10 and 20 inches long, beyond the rear end of the head. The entire plunger typically will thus be less than two feet long and only several inches wide. By contrast, a conventional plungers might typically be almost twice as large, having a 4–6 inch outer diameter or width head and a corresponding axial length, and the shaft might be between 2 and 3 feet long beyond the head. For toilets having larger bowl passages, the plunger head can be made with a correspondingly larger diameter, but yet it will be sized to fit into and become seated with the bowl passage and be axially moveable therein.

While several embodiments of the invention have been disclosed, minor variations might be made from the disclosure without varying from the overall inventive concept.

Accordingly, the invention is to be limited only but by the scope of the following claims.

What is claimed as my invention is:

1. A portable plunger for low water per flush toilets having bowl walls defining a top edge and an underlying small bore outlet passage, comprising an elongated shaft having a hand gripping portion adjacent one end thereof;

a plunger head fixed to the shaft adjacent the other end thereof;

said shaft being substantially nonextendable axially, and of a length to position said hand gripping portion generally above the top bowl edge opposite the outlet passage while said head is fitted in the bowl outlet passage;

said plunger head being made of an impervious flexible material that is also resilient and elastic;

said plunger head defining a maximum exterior surface larger than the bowl outlet passage, operable as the plunger is fitted into the bowl passage in the mode of a piston, to be automatic reshaped radials inward and outward as needed locally to present an annular region substantially seated against the bowl passage wall so as to substantially block the bowl outlet passage; whereby axial shifting of the shaft concurrently shifts the plunger head axially in the bowl passage, operable to hydraulically force water/waste in the outlet passage axially thereof to serve to break up blockage in the outlet passage downstream thereof.

2. A portable plunger according to claim 1, further comprising said shaft having an overall length less than two feet and being bowed between its ends approximately 25–40 degrees from being straight, operable to have said plunger head angled approximately 25–40 degrees from said hand gripping portion so as to minimize head misalignment relative to the bowl outlet passage and to allow axial head shifting within the passage while in sealed association therewith.

3. A portable plunger according to claim 1, further comprising said plunger head exterior surface being in the form of a flexible impervious membrane, and resilient structure underlying the membrane and connected relative to the shaft operable to radially bias the membrane against the bowl passage walls when the plunger head is inserted into the bowl passage.

4. A portable plunger according to claim 1, further comprising said plunger head exterior surface having a plurality of flexible and resilient annular radially extended narrow lobe each radially larger than the passage and axially separated from one another across generally narrow gaps, with said annular region that is seated against the bowl passage wall being defined on the radial ends of said lobes.

5. A portable plunger according to claim 1, further comprising said plunger head is suited for use with a 1.6 gpf toilet having a bowl outlet passage as small as 1 & ⅝ inch inner diameter, and said plunger head has a maximum exterior surface larger than 1 & ⅝ toilet bowl outlet passage.

* * * * *